United States Patent [19]

Lindsey

[11] 4,167,135

[45] Sep. 11, 1979

[54] ANTI-JAM MECHANISM FOR ACTUATION PISTONS

[75] Inventor: Charles T. Lindsey, Irvine, Calif.

[73] Assignee: Bertea Corporation, Irvine, Calif.

[21] Appl. No.: 852,723

[22] Filed: Nov. 18, 1977

[51] Int. Cl.[2] ..... F01B 1/02

[52] U.S. Cl. ..... 92/61; 137/596; 60/484; 91/170 R; 91/509

[58] Field of Search ..... 92/61, 62; 91/411 R, 91/411 A, 411 B, 170, 509; 137/596; 60/403, 484

[56] References Cited

U.S. PATENT DOCUMENTS

| | | | |
|---|---|---|---|
| 2,613,650 | 10/1952 | Mott | 91/20 |
| 3,253,613 | 5/1966 | Richolt | 137/596 |
| 3,439,707 | 4/1969 | York et al. | 137/596 |

*Primary Examiner*—Edgar W. Geoghegan
*Attorney, Agent, or Firm*—Gordon L. Peterson

[57] ABSTRACT

A fluid control unit comprising a drive piston having first and second faces and a drive rod. The drive piston has first and second fluid responsive faces exposable to fluid under pressure. The fluid under pressure acting on the first face urges the drive piston in a first direction and the fluid under pressure acting on the second face urges the drive piston in a second direction. First and second overridable detents drivingly couple the drive piston and the drive rod for movement in first and second directions, respectively. The coupling force provided by the first detent varies with the pressure of the fluid to which the first face of the drive piston is exposed, and the coupling force provided by the second detent varies with the pressure of the fluid to which the second face of the drive piston is exposed.

16 Claims, 5 Drawing Figures

ANTI-JAM MECHANISM FOR ACTUATION PISTONS

BACKGROUND OF THE INVENTION

Hydraulic control systems are often used to control the position of an aircraft flight control surface. A typical hydraulic control system may include a modulating piston, a servo valve and an actuator. The modulating piston mechanically controls the position of the slide of the servo valve and the servo valve controls the flow of fluid to and from the actuator. The actuator positions the flight control surface.

If the hydraulic control system malfunctions, the pilot may lose control of the aircraft, and a crash may result. It is very important, therefore, that the hydraulic control system be very reliable.

One failure that can occur in hydraulic system of this type is the sticking or jamming of the movable elements of the modulating piston or the servo valve. Various techniques are known for preventing a catastrophic failure if one of the slides of the servo valve jams. Servo valves having some form of anti-jam protection are shown, by way of example, in Mott U.S. Pat. No. 2,613,650, Richolt U.S. Pat. No. 3,253,613, and York et al., U.S. Pat. No. 3,439,707.

Jam protection for modulating pistons and similar devices which drive the servo valve has apparently been given much less attention. A typical modulating piston may include, for example, a housing, a piston slidable in the housing, and a drive rod coupled to the piston for mechanically stroking the slide of the servo valve. The position of the piston within the housing may be controlled, for example, by fluid under pressure ported to the opposite faces of the piston by a suitable device, such as an electrohydraulic valve. The electrohydraulic valve may in turn be controlled directly by the pilot of the aircraft or by an automatic mechanism, such as an auto-pilot.

One prior art device which provides some jam protection for modulating pistons includes two modulating pistons of the type described hereinabove with the drive rods from the two modulating pistons being coupled by a spring detent unit. This does provide some jam protection. However, the springs provide very undesirable hysteresis and, when a jam occurs, the output stroke from the modulating piston combination is reduced by 50 percent. In addition, if a jam occurs, it is necessary to overcome the spring force from the spring detent unit. Thus, this prior art device is less than satisfactory.

SUMMARY OF THE INVENTION

The present invention overcomes these disadvantages and provides a fluid control device which maintains full control over the servo valve or other controllable member when a jam occurs. The fluid control device, which may be a modulating piston, has 100 percent of its output stroke even after a jam occurs. When a jam occurs, the force required to operate the device of this invention is substantially the same as the force required during normal operation after the jammed unit is hydraulically disabled. The present invention eliminates the detents of the prior art which created a hysteresis problem.

The control device of this invention utilizes drive means, which may include one or more drive rods, to provide the desired mechanical output. The drive rod is driven by two separate driving elements, each of which may comprise a drive piston. Overridable detent means drivingly couple the drive pistons to the drive rod so that, in normal operation, the drive pistons can drive the drive rod. Each of the detent means is overridable in the event of a jam to decouple the associated drive piston from the drive rod sufficiently to enable the other drive piston to drive the drive rod. In this manner, the jammed drive piston does not prevent the unjammed drive piston from controlling the drive rod.

One feature of this invention is the use of a detent which provides a variable face force between the drive piston and the drive rod which enables the drive piston to drive the drive rod and which enables the detent to be overridden in appropriate circumstances. More particularly, a first detent drivingly couples the drive piston and the drive rod for movement when the piston is moved in a first direction, and a second detent drivingly couples the drive piston and the drive rod for movement when the drive piston is moved in a second direction. The coupling force provided by the first detent varies with the pressure of the fluid to which the first race of the drive piston is exposed, and the coupling force provided by the second detent varies with the pressure of the fluid to which the second face of the drive piston is exposed. Thus, the coupling force provided by a detent is relatively high when that detent is in a driving mode.

Although the relationship between pressure acting on the drive piston and the variable coupling force can be brought about in different ways, this concept can be advantageously implemented by utilizing fluid operated detents. With this arrangement, the variable coupling force varies with the pressure of the fluid supplied to each such detent. Although this result can be brought about in different ways, the implementation is greatly simplified and accuracy is increased by utilizing passage means leading from the opposite faces of the drive piston to the first and second detents, respectively. With this construction, the passage means ports fluid from the opposite faces of the piston to the associated detents.

The other drive piston may be arranged to drive the drive rod through an identical pair of detents in the same manner. The detents are also arranged so that the detent communicating with the low pressure side of the piston will not resist movement of the drive rod in the other direction. However, if one of the pistons jams and if the same pressures are thereafter provided to both of the pistons, only the detent which provides a relatively low coupling force must be overridden.

Mechanically, the two drive pistons can be arranged in various different ways, such as coaxially or side by side. The drive means may include a single drive rod when the pistons are coaxial and two separate drive rods suitably interconnected when the pistons are arranged in side-by-side relationship. The output may be taken off of the drive rod at any desired location.

In a preferred construction, each of the drive pistons has a bore, and the drive rod extends through these bores. In normal operation, the detents drivingly couple the drive pistons to the drive rod so that the two pistons and the drive rod move together as a unit. However, if a jam occurs, the detent for the jammed piston can be overridden to allow the drive rod to slide in the bore of the jammed piston to thereby enable the other drive piston to drive the drive rod.

The invention, together with further features and advantages thereof, may best be understood by reference to the following description taken in connection with the accompanying illustrative drawings.

DESCRIPTION OF THE PREFERRED EMBODIMENT

Figure 1:
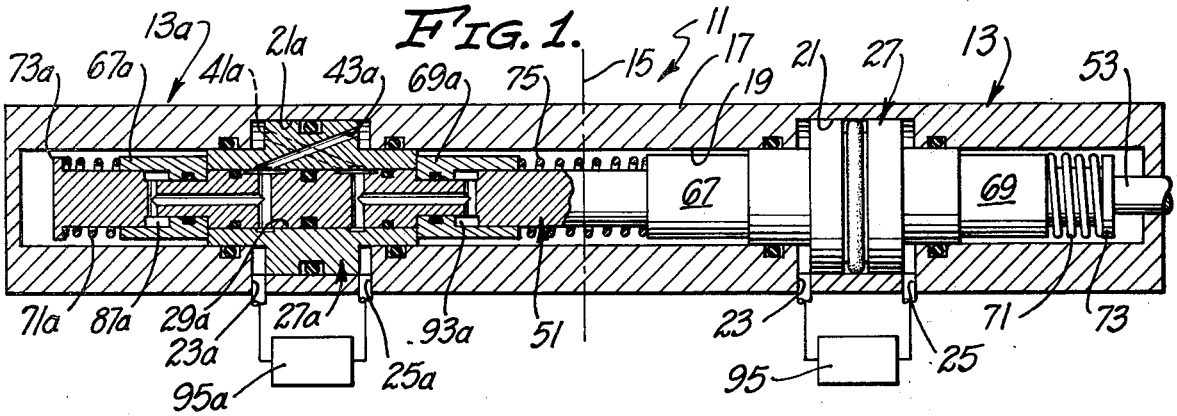
FIG. 1 is a schematic sectional view partially in elevation of a fluid control device coupled to electrohydraulic valves and constructed in accordance with the teachings of this invention with the drive pistons being at null.

FIG. 1 shows a fluid control device 11 in the form of a modulating piston having an anti-jam mechanism. The device 11 is redundant and may be considered as comprising two substantially identical control units 13 and 13*a* which are separated by the imaginary plane designated by the dashed vertical line 15 in FIG. 1.

The control device 11 includes a housing 17 having a main bore 19 and enlarged bores 21 and 21*a* therein. Ports 23, 23*a*, 25 and 25*a* provide communication from the exterior of the housing 17 to the opposite ends of the bores 21 and 21*a*.

Drive pistons 27 and 27*a* are mounted for sliding movement in the bores 21 and 21*a*, respectively. The pistons 27 and 27*a* are identical and portions of the piston 27*a* corresponding to portions of the piston 27 are designated by corresponding reference numerals followed by the letter "a."

Figure 2:
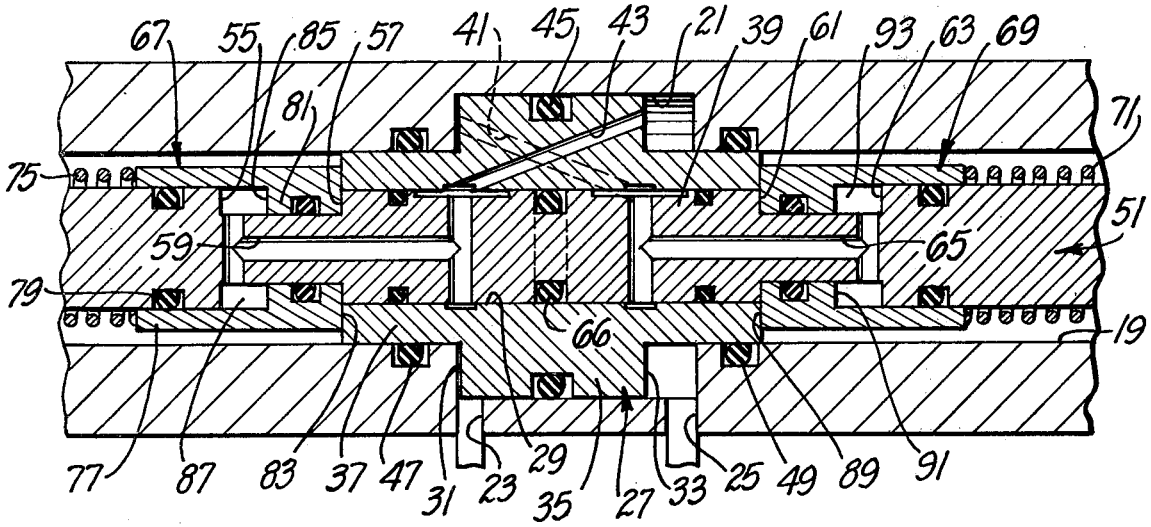
FIG. 2 is an enlarged fragmentary sectional view illustrating one portion of the control device with the drive piston being moved to the left.

The piston 27, which is shown on a larger scale in FIG. 2, has an axial cylindrical bore 29 and annular, parallel piston faces 31 and 33 which extend perpendicularly to the axis of the bore 29. The drive piston 27 has a relatively large diameter cylindrical central section 35 and tubular axial extensions 37 and 39 extending axially from the central section 35 in opposite directions. Passages 41 and 43 provide communication between the bore 29 and the piston faces 31 and 33, respectively. Annular seals 45, 47 and 49 seal the central section 35 and the extensions 37 and 39 in the bores 21 and 19, respectively.

Figure 3:
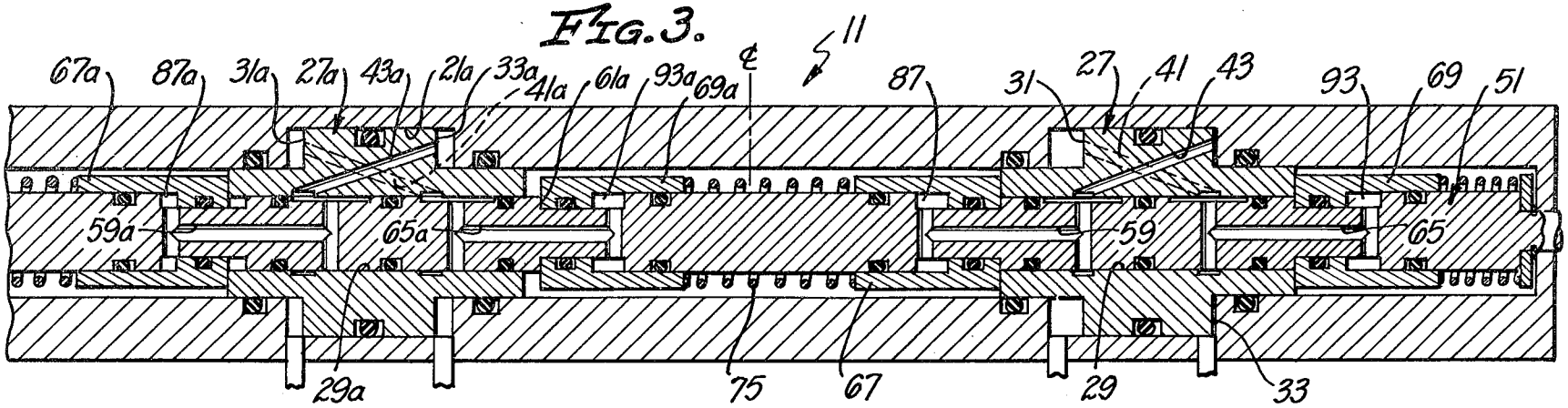
FIG. 3 is a sectional view similar to FIG. 1 illustrating the operation of the device with the left drive piston jammed and with the right drive piston controlling the drive rod.

Drive means in the form of a unitary drive rod 51 extends completely through the bores 29 and 29*a* (FIGS. 1–3). The drive rod 51 is suitably coupled to a controllable member 53, the position of which it is desired to control. Although this can be accomplished in different ways, in the embodiment illustrated, the controllable member 53 includes a drive rod extension which extends through one end of the housing 17 for driving the slide of a servo valve (not shown).

The construction of the drive rod 51 adjacent the drive piston 27 is identical to the construction of the drive rod adjacent the drive piston 27*a*. Accordingly, these portions of the drive rod 51 are designated by corresponding reference numerals followed by the letter "a."

As best shown in FIG. 2, the drive rod 51 has a pair of annular shoulders 55 and 57 which are axially spaced apart to define a groove, and an axial and radial passage 59 provides communication between the passage 43 in the drive piston 27 and this groove. Similarly, to the right of the drive piston 27 as viewed in FIG. 2, the drive rod 51 has shoulders 61 and 63 which cooperate to define a groove, and an axial and radial passage 65 provides communication between the passage 41 in the drive piston 27 and this groove. An O-ring seal 66 seals the drive rod 51 in the bore 29.

Identical tubular detent sleeves 67 and 69 are mounted for sliding movement on the drive rod 51 adjacent the drive piston 27. Corresponding and identical detent sleeves 67*a* and 69*a* are mounted adjacent the drive piston 27a. A light spring 71 (FIGS. 1 and 2) acts between a shoulder 73 on the drive rod 51 and the right end face of the detent sleeve 69 to lightly urge the latter to the left as viewed in FIGS. 1 and 2. A spring 75 acts between the opposite ends of the detents 67 and 69a to lightly urge these detents toward their respective drive pistons 27 and 27a.

The detent sleeve 67 includes a skirt 77 slidably mounted on a relatively large diameter portion of the drive rod 51 with the interface being sealed by an O-ring seal 79 and an axially thick annular flange 81 projecting radially inwardly from the skirt 77. The flange 81 has a face 83 adapted to engage the left end of the drive piston 27 and an opposite surface or face 85 which cooperates with the shoulder 55, the skirt 77 and the reduced diameter portion of the drive rod 51 to define an annular chamber 87. The detent sleeve 69 is of identical construction and has faces 89 and 91, and it cooperates with the drive rod 51 to define an annular chamber 93.

With this arrangement, the fluid under pressure acting against the face 33 of the drive piston 27 is transmitted to the chamber 87 via the passages 43 and 59. Similarly, the fluid under pressure acting on the face 31 of the drive piston 27 is supplied to the chamber 93 via the passages 41 and 65.

In order to move the piston 27 to the left from the position shown in FIG. 1 to the position shown in FIG. 2, it is necessary to supply fluid through the port 25 at greater pressure than the fluid supplied through the port 23. This in turn causes relatively high pressure to exist in the chamber 87 and relatively low pressure to exist in the chamber 93. The fluid under pressure in the chamber 87 acts against the face 85 of the detent sleeve 67 to hold the face 83 of the detent sleeve 67 against the left end of the drive piston 27 and against the shoulder 57 of the drive rod 51. Thus, as the drive piston 27 begins to move to the left toward the position shown in FIG. 2, the relatively high pressure fluid column acting in the chamber 87 maintains the engagement of the face 83 against the drive piston 27 and prevents the detent sleeve 67 from moving to the left relative to the drive rod 51 so as to reduce the axial dimension of the chamber 87. Consequently, the movement of the drive piston 27 is transmitted through the flange 81 of the detent sleeve 67 and the fluid column in the chamber 87 to the shoulder 55 of the drive rod 51. Consequently, the drive rod 51 moves to the left with the drive piston 27 as shown in FIG. 2. The detent sleeve 69 and the fluid column in the chamber 93 do not resist movement of the drive rod 51 to the left because the detent sleeve 69 can move to the left with the drive rod 51.

If the fluid pressure differential across the drive piston 27a also tends to move that piston to the left, then the two drive pistons 27 and 27a cooperate to bring about movement of the drive rod 51 to the left. In this event, the piston 27a cooperates with the detent sleeves 67a and 69a in the same manner described above for the piston 27 and the detent sleeves 67 and 69. In this connection, the detent sleeves 67a and 69a cooperate with the drive rod 51 to define chambers 87a and 93a, respectively.

Each of the pistons 27 and 27a may be controlled by different electrohydraulic valves 95 and 95a (FIG. 1) in a known manner. Accordingly, it is possible that the differential fluid pressure acting across the piston 27 may tend to move that piston to the left while the differential pressure acting across the drive piston 27a may tend to move that piston to the right. In this event, opposing forces are transmitted to the drive rod 51, and the higher of these two forces will control so that the net result is movement of the drive rod 51 in the direction dictated by the higher of these two differential fluid pressures.

FIG. 3 shows the operation of the fluid control device 11 when a jam occurs. As shown in FIG. 3, the drive piston 27a has jammed in the bore 21a. Differential fluid pressure acts on the drive piston 27 in a direction tending to move the drive piston 27 to the right as viewed in FIG. 3. Accordingly, fluid under pressure acting on the face 31 is transmitted via the passages 41 and 65 to the chamber 93 to provide a relatively high pressure column in that chamber. This establishes a driving connection from the piston 27 through the detent sleeve 69 to the drive rod 51. Relatively lower fluid pressure acts on the face 33 of the drive piston 27 and is transmitted via the passages 43 and 59 to the chamber 87. The fluid in the chamber 87 and the detent sleeve 67 do not resist movement of the piston 27 and the drive rod 51 to the right. After a jam is detected, the jammed piston may be hydraulically disabled using known techniques.

Assuming that the piston 27a is subjected to substantially the same fluid pressures as the piston 27, relatively high pressure acts on the face 31a and is transmitted to the chamber 93a via the passages 41a and 65a. This relatively high fluid pressure maintains the detent sleeve 69a urged to the left along the drive rod 51 as far as is permitted by the shoulder 61a of the drive rod. Accordingly, the fluid in the chamber 93a and the detent sleeve 69a do not assist or hinder movement of the drive rod 51a to the right under the influence of the drive piston 27.

Fluid at relatively lower pressure acts on the face 33a of the drive piston 27a and is transmitted to the chamber 87a through the passages 43a and 59a. Because the detent sleeve 67a engages the drive piston 27a which is jammed, this detent sleeve cannot move to the right. Accordingly, in order for the drive rod 51 to be moved to the right, it is necessary that the drive rod 51 move axially relative to the drive piston 27a, and to bring this about, the piston 27 must apply sufficient force to the drive rod 51 to overcome the fluid pressure acting in the chamber 87a, i.e., sufficient force to override the detent. As shown in FIG. 3, it is assumed that the drive piston 27 did provide the requisite force to override the detent thereby enabling the drive rod 51 to be moved to the right. This reduces the axial dimension of the chamber 87a.

As indicated above, it is possible for the differential pressures across the drive pistons 27 and 27a to tend to move these pistons in opposite directions. If the fluid under pressure applied to the jammed portion 27a tends to move that piston to the left as viewed in FIG. 3, then relatively high pressure would act on the face 33a and would exist in the chamber 87a. This means that a greater force would be required by the piston 27 to move the drive rod 51 to the right.

The ratio of the coupling force provided by each of the detents to the force acting on the drive pistons 27 and 27a can be controlled by appropriately selecting the relative areas of the piston faces 31 and 33 and the faces 85 and 91 of the detent sleeves 67 and 69. For example, in order to assure that the detent sleeve 67 will not be forced away from the shoulder 57 of the drive rod 51 by the fluid pressure acting on the face 33, it is necessary that the area of the face 85 be equal to or greater than the area of the face 33 of the piston 27. This assumes that the pressures acting on these two faces are substantially equal, that the spring 75 is light, and that the area of the shoulder 55 and the face 85 are equal. However, if the area of the face 85 exceeds the area of the face 33 by a very substantial amount, then this detent becomes progressively more difficult to override in the case where the piston 27 is jammed and the fluid pressure applied to the piston 27 tends to move the drive rod 51 in a direction opposite to the direction in which the unjammed drive piston 27a tends to move the drive rod. These relative areas can be selected depending upon the results desired. However, it has been found that, for some applications, the area of the face 85 should be about 10 percent greater than the area of the face 33. Of course, the other detent faces and piston faces can be sized in the same manner.

Figure 4:
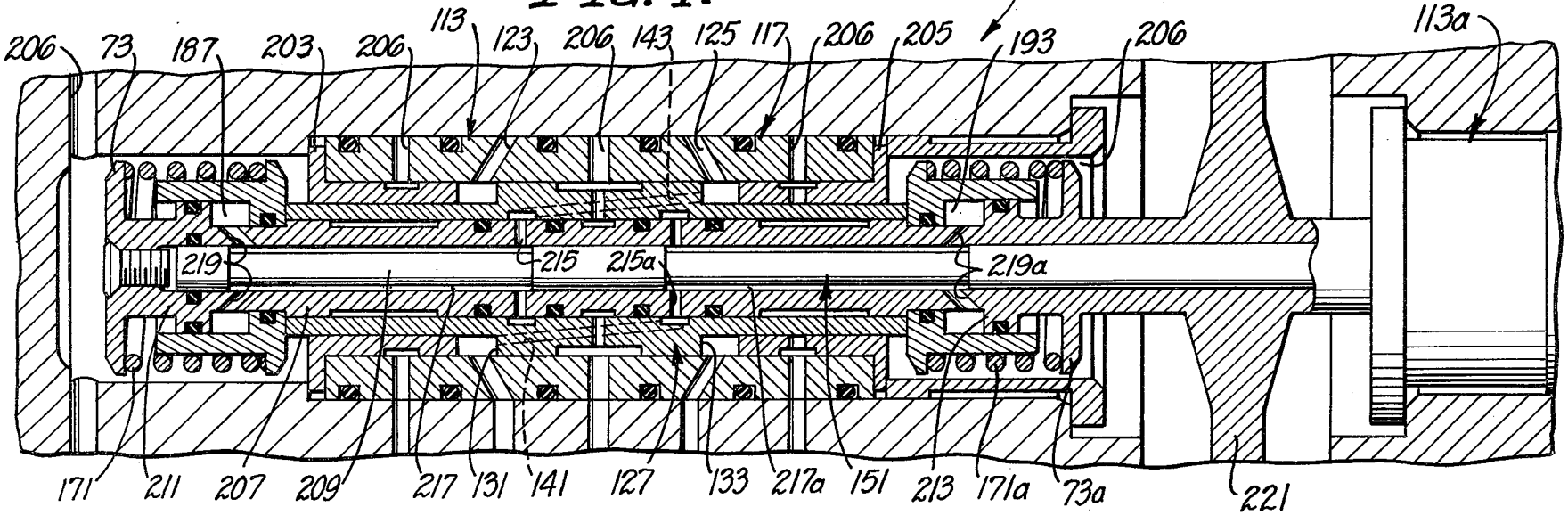
FIG. 4 shows a second embodiment of a fluid control device.

FIG. 4 shows a fluid control device 111 which is identical to the fluid control device 11 in all respects not shown or described herein. Basically, the control device 111 is functionally identical to the control device 11 and the differences relate primarily to the configuration of the components. Portions of the control device 111 corresponding to portions of the control device 11 are designated by corresponding reference characters preceded by the numeral "1."

The housing 117 is constructed of multiple sections to facilitate assembly of the control device 111. For example, the housing 117 includes a main body 201 and fixed insert sleeves 203 and 205, all of which are inserted into a bore in a main body. The sleeve has a plurality of ports 206, all of which communicate with fluid at return pressure.

The drive rod 151 includes an outer sleeve 207 and an inner rod 209 fixed to the sleeve 207. End members 211 and 213 are suitably attached to the inner rod 209 with the end members providing the shoulders 73 and 73a, respectively. Communication is provided from the face 133 to the chamber 187 by way of the passage 143, a port 215 in the sleeve 207, an annular passage 217 and a plurality of ports 219. Communication is provided between the face 131 and the chamber 193 by way of a passage 141, a port 215a, an annular passage 217a, and a plurality of ports 219a.

In the embodiment of FIG. 4, the control units 113 and 113a are axially arranged in spaced relationship, and a controllable output member 221 is coupled to the drive rod 151 between the two control units and to a servo valve (not shown).

Figure 5:
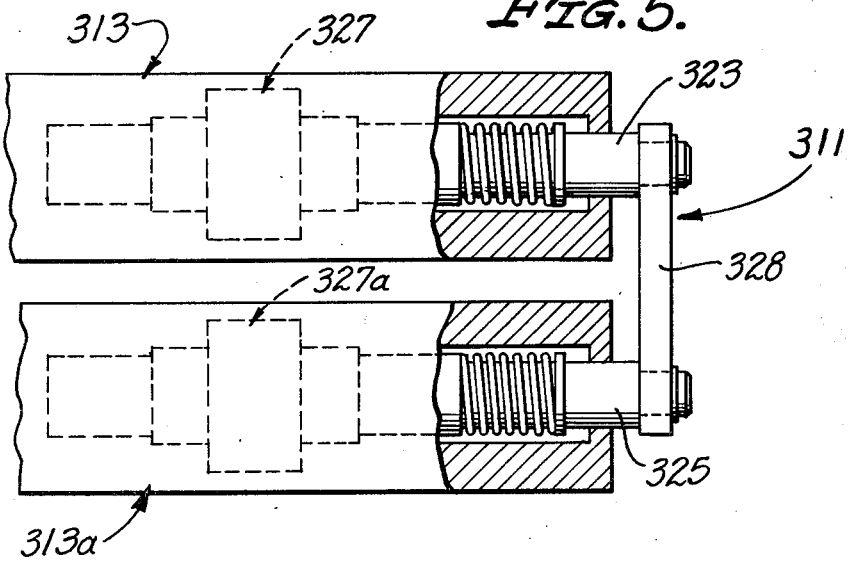
FIG. 5 is a fragmentary view partly in section of another embodiment of a fluid control device in which the two drive pistons are arranged in side-by-side relationship.

FIG. 5 shows a fluid control device 311 which may be identical to either of the embodiments described above, except that it comprises two control units 313 and 313*a* which are arranged in side-by-side relationship rather than axially. Portions of the device 311 corresponding to portions of the device 11 are designated by corresponding reference characters preceded by the numeral "3."

In the embodiment of FIG. 5, the drive rod includes two drive rods 323 and 325 suitably mechanically coupled by a rigid member 328. The control device 311 operates in the same manner described above for the control device 11.

Although exemplary embodiments of the invention have been shown and described, many changes, modifications and substitutions may be made by one having ordinary skill in the art without necessarily departing from the spirit and scope of this invention.

I claim:

1. A fluid control device comprising:

a drive piston having first and second faces;

drive means;

means for mounting said drive piston and said drive means for movement;

said drive piston having first and second fluid responsive faces exposable to fluid under pressure with the fluid pressure acting on said first face urging said drive piston in a first direction and the fluid pressure acting on said second face urging the drive piston in a second direction;

first overridable detent means for drivingly coupling the drive piston and the drive means for movement with a first variable coupling force when the drive piston is moved in said first direction with the first coupling force varying with the pressure of the fluid to which the first face of the drive piston is exposed; and second overridable detent means for drivingly coupling the drive piston and the drive means for movement with a second variable coupling force when the drive piston is moved in said second direction with the second coupling force varying with the pressure of the fluid to which the second face of the drive piston is exposed.

2. A fluid control device as defined in claim 1 including a second drive piston, means for mounting said second drive piston for movement, said second drive piston having first and second fluid responsive faces exposable to fluid under pressure with the fluid pressure acting on said first face of the second drive piston urging said second drive piston in said first direction and the fluid pressure acting on said second face of said second drive piston urging the second drive piston in said second direction, third overridable detent means for drivingly coupling the second drive piston and the drive means for movement with a third variable coupling force when the second drive piston is moved in said first direction with the third coupling force varying with the pressure of the fluid to which the first face of the second drive piston is exposed, and fourth overridable detent means for drivingly coupling the second drive piston and the drive means for movement with a fourth variable coupling force when the drive piston is moved in said second direction with the fourth coupling force varying with the pressure of the fluid to which the second face of the second drive piston is exposed.

3. A fluid control device as defined in claim 2 wherein at least said first detent means is pressure responsive and said control device includes means for supplying fluid under pressure to said first detent means to provide at least a portion of said first variable coupling force.

4. A fluid control device as defined in claim 2 wherein each of said detent means is fluid operated and provides the associated variable coupling force in response to fluid under pressure and means for supplying fluid under pressure to each of said detent means, said last-mentioned means including passage means providing communication between the first face of the first drive piston and the first detent means.

5. A fluid control unit comprising:

a drive piston having first and second faces;

a drive rod;

means for mounting said drive piston and said drive rod for movement;

said drive piston having first and second fluid responsive faces exposable to fluid under pressure with the fluid pressure acting on said first face urging said drive piston in a first direction and the fluid pressure acting on said second face urging the drive piston in a second direction;

first fluid operated overridable detent means for drivingly coupling the drive piston and the drive rod for movement when the drive piston is moved in said first direction;

second fluid operated overridable detent means for drivingly coupling the drive piston and the drive rod for movement when the drive piston is moved in said second direction whereby said drive piston can drive said drive rod through said first and second detent means;

means for supplying fluid under pressure to said first detent means with the pressure of the fluid supplied to the first detent means being related to the pressure of the fluid to which said first face of said drive piston is exposable;

means for supplying fluid under pressure to said second detent means with the pressure of the fluid supplied to the second detent means being related to the pressure of the fluid to which said second face of said drive piston is exposed; and each of said fluid operated detent means drivingly coupling the drive piston to the drive rod with a coupling force which varies with the pressure of the fluid supplied to such detent means.

6. A control unit as defined in claim 5 wherein said first-mentioned supplying means includes passage means leading from said first face of said drive piston to said first detent means.

7. A control unit as defined in claim 5 wherein said first detent means includes a detent sleeve slidably mounted on said drive rod, the fluid under pressure supplied to said first detent means urging said detent sleeve against said drive piston.

8. A control unit as defined in claim 7 wherein said detent sleeve has a surface exposed to the fluid under pressure at said first detent means for urging said detent sleeve against said drive piston, the area of said surface of said detent sleeve being greater than the area of said first face of said drive piston.

9. A control unit as defined in claim 8 wherein means including said detent sleeve and said drive rod define a chamber, said first-mentioned supplying means includes passage means extending from said first face of said piston to said chamber, said drive piston having a bore therein and said drive rod extending through said bore, the fluid under pressure in said chamber urging said detent sleeve against the drive piston.

10. A fluid control device for controlling a controllable member comprising:

first and second fluid responsive drive pistons, each of said pistons having a bore therein;

drive means adapted to be coupled to the controllable member;

housing means for mounting said first and second drive pistons and said drive means for movement with said drive means extending into said bores of said drive pistons;

first detent means for drivingly coupling the first drive piston to the drive means so that the first drive piston can drive the drive means;

second detent means for drivingly coupling the second drive piston to the drive means so that the second drive piston can drive the drive means; and each of said detent means including overridable means responsive to jamming of the associated drive piston to decouple such associated drive piston from the drive means sufficiently to allow the drive means to move in the bore of the associated drive piston relative to such associated drive piston to enable the other drive piston to drive the drive means whereby the jammed drive piston does not prevent the unjammed drive piston from controlling the drive means.

11. A fluid control device as defined in claim 10 wherein said first detent means includes a detent sleeve mounted on said drive means and engageable with said first drive piston.

12. A fluid control device as defined in claim 10 wherein said first detent means is fluid operated and passage means is provided for porting fluid under pressure to said first detent means to operate the first detent means.

13. A fluid control device as defined in claim 12 wherein said first drive piston has opposite faces exposable to fluid under pressure in said housing means to control the movement of said first piston and said passage means extends from one of said faces of said first drive piston to said first detent means whereby said first detent means is operable by fluid under pressure from said one face of said first drive piston.

14. A fluid control device as defined in claim 10 wherein said first detent means is fluid operated and said device includes means for providing one face of said first drive piston and said first detent means with fluid at substantially the same pressure.

15. A fluid control device as defined in claim 10 wherein said first detent means includes means defining a chamber adapted to contain a fluid column and passage means for providing fluid under pressure in said chamber to establish said fluid column, said first drive piston being capable of driving said drive means through said fluid column when said first drive piston is not jammed.

16. A fluid control device as defined in claim 10 wherein said bore in said first drive piston extends completely through the first drive piston and said drive means extends completely through said bore, said first detent means includes first and second detent sleeves mounted for movement on said drive means at the opposite ends of said first drive piston, each of said detent sleeves cooperating with portions of said drive means to define a chamber, said piston having opposite faces exposable to fluid under pressure to control the movement of said first drive piston, first and second passage means for providing communication between the opposite faces of said first drive piston and said chambers, respectively, whereby fluid columns can be established in each of said chambers, said piston being capable of driving said drive means in one direction through one of said fluid columns and in the other direction through the other of said fluid columns.

* * * * *